US011203890B2

(12) United States Patent
Davis et al.

(10) Patent No.: US 11,203,890 B2
(45) Date of Patent: Dec. 21, 2021

(54) REDUCED POWER CONSUMPTION ELECTROMAGNETIC LOCK

(71) Applicant: Hanchett Entry Systems, Inc., Phoenix, AZ (US)

(72) Inventors: Brett L. Davis, Gilbert, AZ (US); Randall Shaffer, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 1616 days.

(21) Appl. No.: 15/097,571

(22) Filed: Apr. 13, 2016

(65) Prior Publication Data

US 2017/0226784 A1 Aug. 10, 2017

Related U.S. Application Data

(60) Provisional application No. 62/293,185, filed on Feb. 9, 2016.

(51) Int. Cl.

| | |
|---|---|
| ***E05C 19/16*** | (2006.01) |
| ***E05B 47/00*** | (2006.01) |
| ***G07C 9/00*** | (2020.01) |

(52) U.S. Cl.

CPC ..... *E05C 19/166* (2013.01); *E05B 47/00* (2013.01); *G07C 9/00174* (2013.01); *E05B 2047/0068* (2013.01); *G07C 2009/00634* (2013.01)

(58) Field of Classification Search

USPC ..... 292/251.5

See application file for complete search history.

(56) References Cited

U.S. PATENT DOCUMENTS

| | | | | |
|---|---|---|---|---|
| 4,453,065 A * | 6/1984 | Taylor, Jr. | H05B 6/6417 | 126/197 |
| 4,720,128 A * | 1/1988 | Logan, Jr. | E05C 19/166 | 292/251.5 |
| 4,763,937 A * | 8/1988 | Sittnick, Jr. | E05B 49/00 | 292/251.5 |
| 4,871,204 A * | 10/1989 | Cook | E05B 47/0002 | 292/251.5 |
| 4,893,852 A * | 1/1990 | Harris | E05B 47/00 | 250/342 |
| 5,065,136 A * | 11/1991 | Frolov | E05B 65/108 | 292/251.5 |
| 5,184,855 A * | 2/1993 | Waltz | E05C 19/168 | 292/251.5 |

(Continued)

*Primary Examiner* — Carlos Lugo

(74) *Attorney, Agent, or Firm* — Woods Oviatt Gilman LLP; Ronald J. Kisicki, Esq.; Dennis B. Danella, Esq.

(57) ABSTRACT

An energizable electromagnet of a door locking system is affixed to the door or the door frame for electromagnetically attracting an armature affixed to the other. A power control circuit is configured to selectively energize the electromagnet using a pulse-width modulated current cycle wherein two levels of magnetic force may be selectively applied to the system. A door position sensor is configured to provide a first communication signal to the power control circuit when the door is in a closed position. A second communication signal is provided when the door is not in the closed position. The electromagnet is energized at the lower level of magnetic force when the power control circuit receives the first communication signal and at the higher level of magnetic force only when an unauthorized attempt to open the door is initiated.

16 Claims, 5 Drawing Sheets

(56) References Cited

U.S. PATENT DOCUMENTS

| | | | | |
|---|---|---|---|---|
| 6,049,287 | A * | 4/2000 | Yulkowski | A62C 2/24 292/251.5 |
| 6,053,546 | A * | 4/2000 | Frolov | E05C 19/166 292/144 |
| 6,609,738 | B1 * | 8/2003 | Roth | E05B 65/108 292/144 |
| 8,094,017 | B2 | 1/2012 | Hunt et al. | |
| 8,820,803 | B2 * | 9/2014 | Hunt | E05B 65/108 292/251.5 |
| 2010/0230979 | A1 * | 9/2010 | Gries | E05C 19/16 292/251.5 |
| 2010/0325967 | A1 | 12/2010 | Pearson et al. | |
| 2011/0018680 | A1 | 1/2011 | Lai et al. | |

* cited by examiner

REDUCED POWER CONSUMPTION ELECTROMAGNETIC LOCK

CROSS-REFERENCE TO RELATED APPLICATIONS

This application claims the benefit of U.S. patent application Ser. No. 62/293,185, filed Feb. 9, 2016, the contents of which are hereby incorporated by reference in its entirety.

TECHNICAL FIELD

The present invention relates to a locking system; more particularly, to an electromagnetic door locking system; and most particularly, to an electromagnetic door locking system having power saving features.

BACKGROUND OF THE INVENTION

Existing electromagnetic circuits employed within door locking systems constantly supply power to the electromagnet to keep the door locked. In the current art, the electromagnetic coil of the door locking system may include two windings to accommodate two levels of available voltage supplies in the field, as for example, a 12 volt DC supply or a 24 volt voltage supply. In order to provide the magnetic holding force needed to hold the door closed against an unauthorized opening, the two windings may be selectively connected either in parallel when a 12 volt DC supply is available or switched to a serial connection format when a 24 volt DC supply is available.

In either case, when an authorization signal is initiated by a key pad or swipe card or the like, power may be cut off to the electromagnet and the door allowed to be opened. In some cases, there is a timer built into the circuit that will delay re-electrification of the electromagnet for a customer-determined amount of time, such as up to 30 seconds. After this time has expired, regardless of the state of the door (opened or closed), full power is returned to the electromagnet to again lock the door as determined by the discrete, field-selected circuitry based upon the given power supply. The selected delay allows sufficient time to complete passage through an unlocked door after a signal to release the door lock is received.

These systems suffer from a number of significant drawbacks. For instance, a great deal of energy (electricity) is wasted while powering the door lock when the door is closed and no attempts are made to open the secured door. That is, the electromagnetic lock is fully powered to prevent unwanted breach when nobody is attempting to create such a breach. Similarly, re-energizing the electromagnet after a fixed delay may unnecessarily expend energy. For instance, if an authorized individual takes longer to pass through the doorway than the delay period, that portion of time in which the electromagnet is re-energized without the door being closed constitutes power waste. In a dramatic example, should the door be propped open such power waste may be substantial. This waste is not only detrimental to the environment, but also unnecessarily increases the electricity costs incurred by the door owner.

What is needed in the art is an electromagnetic door locking system whereby a precise magnetic holding force, as needed, may be established by providing power to the magnetic coil(s) in an adjustable pulse-width modulated (PWM) wave form and further, wherein the PWM circuitry provides a constant current flow, even when the PWM wave is in the "off" portion of its cycle, in order to reduce the total energy supplied by the power source.

A further need includes an efficient electromagnetic locking system wherein the power to the electromagnet is increased when an unauthorized attempt is made to open the door. The electromagnet should have a resting state wherein only enough power is supplied to keep the door in a locked state when subjected to environmental stimuli, such as a gust of wind. Should a more forceful attempt be made to open the door, such as through an unauthorized attempt to push or pull the door open, power should be increased to the electromagnet to thereby generate a greater magnetic holding force so as to prevent unauthorized access.

What is further needed is circuitry that will not energize the coils when power not necessary to secure the door closed.

It is a principal object of the present invention to provide an energy-efficient electromagnetic door locking system once the door has been opened by an authorized individual, as well as a system to more energy-efficiently secure the door from unauthorized opening.

SUMMARY OF THE INVENTION

Briefly described, an energizable electromagnet is affixed to the door or the door frame for electromagnetically attracting an armature. The armature is affixed to the other of the door or door frame. When the door is in the closed position and the electromagnet is energized, the armature is attracted to the electromagnet thereby placing the door in a locked mode. A power control circuit is configured to selectively energize the electromagnet. A door position sensor is configured to provide a first communication signal to the power control circuit when the door moves from the closed position toward the open position. A second communication signal is provided when the door moves from the open position to the closed position. The electromagnet is re-energized when the power control circuit receives the second communication signal.

In accordance with an aspect of the present invention, the electromagnetic lock system may further comprise an authentication module connected to the power control circuit. The authentication module may be configured to receive access credentials and send an authentication signal to the electromagnet wherein the electromagnet is de-energized upon receipt of the authentication signal for a predetermined period of time. If the door position sensor does not provide the first communication signal within the predetermined period of time, the electromagnet is re-energized upon termination of the predetermined period. Alternatively, if the door position sensor provides the first communication signal, the electromagnet is energized upon receipt of the second communication signal irrespective of the predetermined period of time. The predetermined period of time may be any suitable time period, such as 30 seconds.

In accordance with a further aspect of the present invention, the door position sensor may be selected from one or more of the following: an accelerometer, a capacitive sensor, a voltage sensor, a current sensor, an image sensor, a photo sensor, a pressure sensor, a micro-switch, a passive infrared sensor, a radio frequency (RF) sensor, a reed switch or a sensor capable of measuring a change in electromagnet coil current or voltage which is indicative of the onset of armature separation from the electromagnet, upon an unauthorized attempt to open the door.

In accordance with yet a further aspect of the invention, one or more back-up door position sensors may be included to provide a redundant first communication signal to the power control circuit, as back-up, in the event that one of the door position sensors has malfunctioned. Circuitry may also be provided wherein an alarm is sent upon sensing a door position sensor malfunction.

In accordance with another aspect of the present invention, the authentication module is one or more of a keypad, swipe card reader, key fob reader, or biometric sensor.

In accordance with yet a further aspect of the present invention, the electromagnet is selectively energized with a system voltage having a first current so as to provide a low holding force or having a second current so as to provide a high holding force. The power control circuit comprises a pulse-width modulator controller configured to selectively output the appropriate pulse-width modulated signal in response to the first communication signal. When the door is in the closed position, the pulse-width modulator controller outputs the appropriate pulse-width modulated signal thereby providing a feedback voltage based on a current-sense circuit to the pulse-width modulator controller. The pulse-width modulator controller cycles at a low duty ratio to produce the first current to energize the electromagnet so as to provide the low holding force. When the door position sensor provides the first communication signal (i.e., the onset of an unauthorized attempt to open the door), the pulse-width modulator controller outputs the appropriate pulse-width modulated signal thereby providing a feedback voltage based on a current-sense circuit to the pulse-width modulator controller. The pulse-width modulator controller cycles at a high duty ratio to produce the second current to energize the electromagnet so as to provide the high holding force.

In accordance with another aspect of the invention, during the off-portion of the pulse width modulated duty cycle, a level of inductive current continues to flow through the magnetic core windings. The inductance associated with the windings when the current through the windings change (due to the "on/off" pulse-width modulated current to the windings) discharges stored energy contained in the windings thereby maintaining a constant current flow through the windings. During the on-portion of the duty cycle, the energy that was lost from the windings during the off-portion of the duty cycle is replenished, enabling the above-described constant current flow through the windings to be maintained.

In accordance with another aspect of the present invention, the pulse-width modulator controller operates at a duty ratio whereby the low-current feedback voltage and the high-current feedback voltage are maintained at the system voltage.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
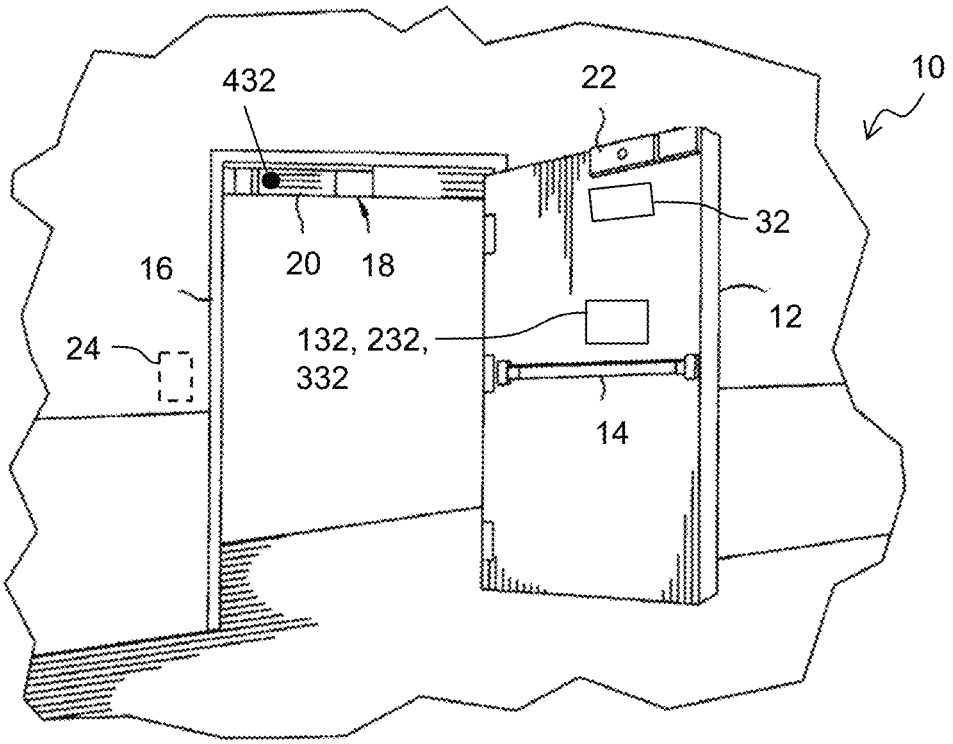
FIG. 1 is an exploded isometric view of an electromagnetic door locking system in accordance with the present invention.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

As used herein, the term "unauthorized attempt to open the door" shall mean a forceful attempt to open the door to gain unauthorized entry to an area secured by the door. The term "naturally occurring external forces" shall mean forces that may be applied to the door (such as wind forces or vibration) that may move the door from its closed position other than forces attributed to an unauthorized attempt to open the door. Referring to FIG. 1, in an electromagnetic door locking system 10 in accordance with the present invention, mounted to door frame 16 is an electromagnet assembly 18 including electromagnet 20. Door 12 is provided with an armature 22 for electromagnetically locking to electromagnet 20. In a secured setting, an authentication device 24, such as a keypad, swipe card reader, key fob reader or biometric sensor may be provided whereby the electromagnet 20 de-energizes only upon input of proper access credentials at authentication device 24, thereby releasing armature 22 from electromagnet 20. Door 12 may optionally be equipped with a mechanical door release mechanism 14, such as a push bar, that operates a latch (not shown), the latch engaging a corresponding recess in door frame 16. Note that the latch could also be operated by a door knob or door lever set. To open door 12 using door release mechanism 14, a person pushes on door release mechanism 14 which causes the latch to be released from the recess in the door frame, and thereby allow pushing of the door outwardly only if the electromagnet is de-energized as described above.

Figure 2:
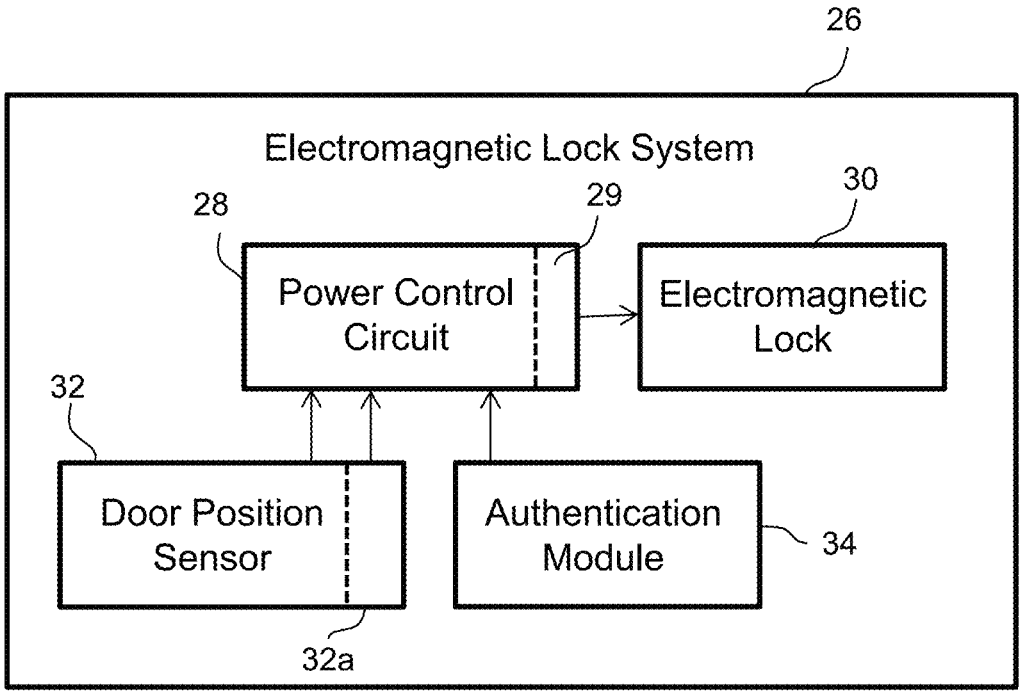
FIG. 2 is a block diagram of a locking system incorporating an embodiment of an electromagnetic door lock in accordance with the present invention.

Referring now to FIG. 2, a block diagram of an embodiment of the electromagnetic door locking system in accordance with the present invention is indicated by reference numeral 26. As shown in FIG. 2, electromagnetic door locking system 26 generally comprises a power control circuit 28 including a microprocessor 29, an electromagnetic lock 30 (such as electromagnet 20 and armature 22), a door position sensor 32 and an authentication module 34 (such as authentication device 24). Door position sensor 32 (shown schematically in FIG. 1) may incorporate any suitable sensor system capable of sensing when the door is closed and not closed. Sensor types may include a photo sensor, a pressure sensor, a micro switch, a passive infrared sensor, a radio frequency (RF) sensor or a reed switch, or the like. A "closed door" position is understood to mean a position of the door when it is generally engaged with the door frame or when the armature of the electromagnet lock is engaged with the electromagnet Therefore, door position sensor 32 may also be a magnetic bond sensor that monitors when an electromagnetic lock armature is seated against the electromagnet, of the type disclosed in U.S. Pat. No. 8,094,017. Door position sensor 32, may also be a magnetic bond sensor that senses a change in the magnetic field as the armature separates from the electromagnet as disclosed in U.S. Publication No. 2010/0325967.

One or more additional door position sensors 32*a* may be included to work as back-up door position sensors should door position sensor 32 fail to perform as intended. Circuitry may be provided so that, if back-up sensor 32*a* senses the door to be closed while sensor 32 does not, an alert signal may be sent back to power control circuit 28, and an alarm signal may be triggered to notify of a malfunctioning door position sensor 32. A similar alarm signal may be triggered if sensor 32 senses a door closed status and back-up door position sensor 32*a* does not.

Electromagnetic lock 30 is electrically coupled to power control circuit 28 and is configured to receive electric power from power control circuit 28 so as to energize electromagnet 20 and secure door 12 within frame 16 via the electromagnetic attraction between electromagnet 20 and armature 22. In accordance with the invention, when door position sensor 32 (or 32*a*) senses that the door is not closed, electrical power is cut off to electromagnet 20.

Figure 3:
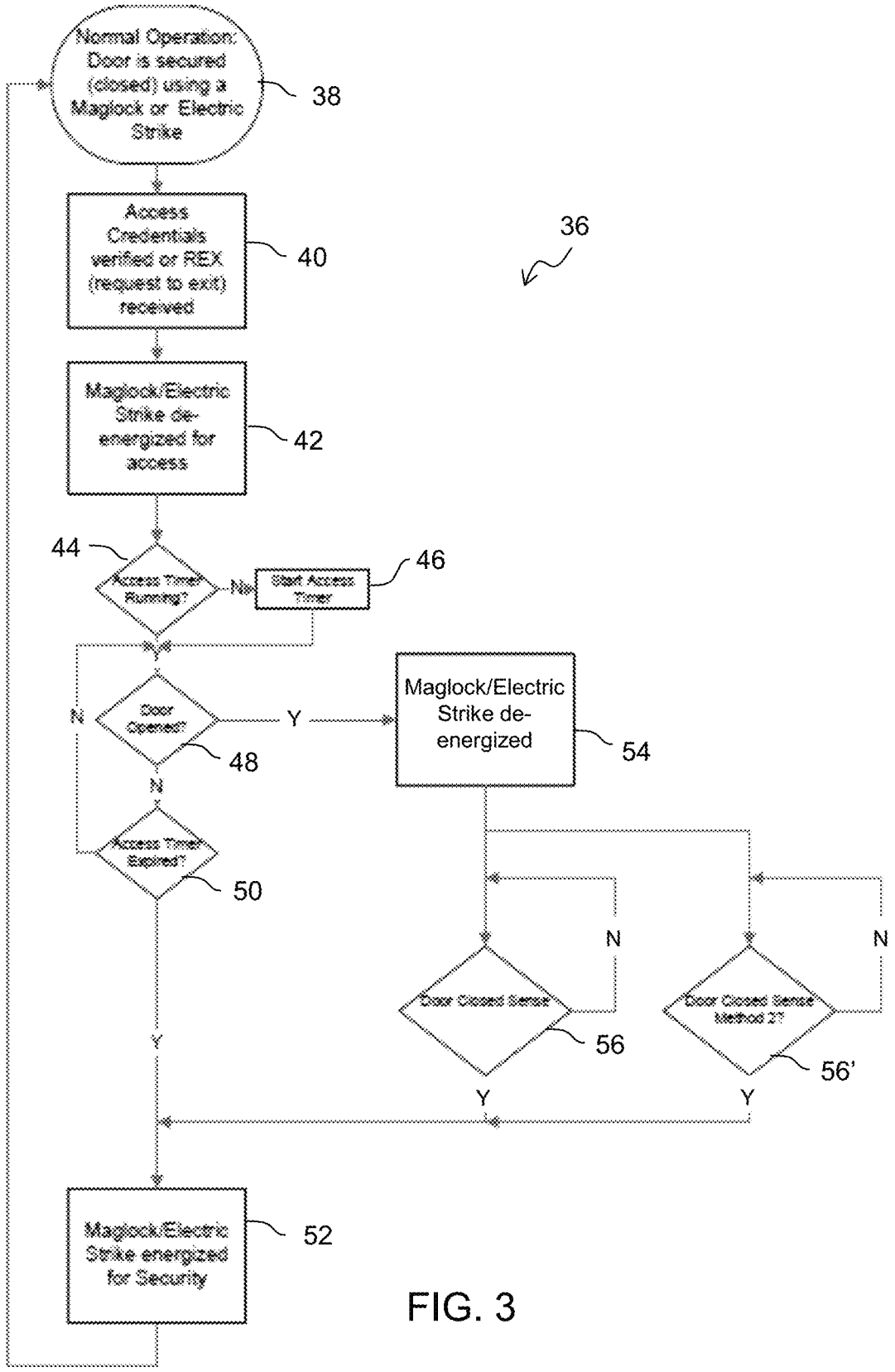
FIG. 3 is a flow chart illustrating an operating method for the electromagnetic door locking system shown in FIG. 2 in accordance with the present invention.

Turning now to FIG. 3, shown is a flow chart illustrating an operating method 36 for electromagnetic door locking system 26 when the door is opened from a closed state, in accordance with the present invention. At step 38, when the door is in a locked state, door position sensor 32 senses the door is closed and electromagnet 20 is energized, thereby securing door 12 within frame 16. In one aspect of the present invention, access credentials are presented to and verified by authentication device 24 (step 40) wherein authentication device sends an authentication signal to power control circuit 28. At step 42, power control circuit 28 then de-energizes electromagnet 20 thereby allowing door 12 to be opened.

Upon receipt of the authentication signal/de-energizing of electromagnet 20, power control circuit 28 may further determine if an access timer has been activated (step 44) and initiate the timer if needed (step 46). The timer may be programmed in the field to keep the electromagnet de-energized for a predetermined period of time, for instance 30 seconds. Power control circuit 28 then interrogates whether door position sensor 32 has provided a door open communication signal indicating that door 12 has moved from a closed position to an open position (step 48). If door position sensor 32 has not indicated that door 12 has been opened, power control circuit 28 determines whether the predetermined period of time set by the timer has expired (step 50). If the predetermined period of time has not expired, power control circuit 28 continues to interrogate whether door position sensor 32 has provided the door open communication signal. However, in step 52, if the predetermined period of time has expired without door position sensor 32 providing the door open communication signal indicating that door 12 has been opened, power control circuit re-energizes electromagnet 20 thereby regenerating the electromagnetic attraction between electromagnet 20 and armature 22 and re-securing door 12 within frame 16.

At step 54, if door position sensor 32 has provided a communication signal to power control circuit 28 that the door is open, power control circuit 28 de-energizes electromagnet 20.

Once power control circuit 28 has received the door open communication signal from door position sensor 32, power control circuit 28 overrides the predetermined period of time set by the timer and maintains electromagnet 20 in its de-energized state until power control circuit 28 receives a door closed communication signal from door position sensor 32 (step 56). If a back-up door position sensor 32*a* is provided, a parallel door closed communication signal is sent (step 56') whereby a receipt of a signal via either step 56 or step 56' will re-energize electromagnet 20.

As depicted in method 36 (FIG. 3), electromagnet 20 will be re-energized irrespective of the predetermined period of time should door 12 be opened and closed, and only when the door is closed, thereby affording greater safety with improved energy efficiencies over the current art.

Figure 3A:
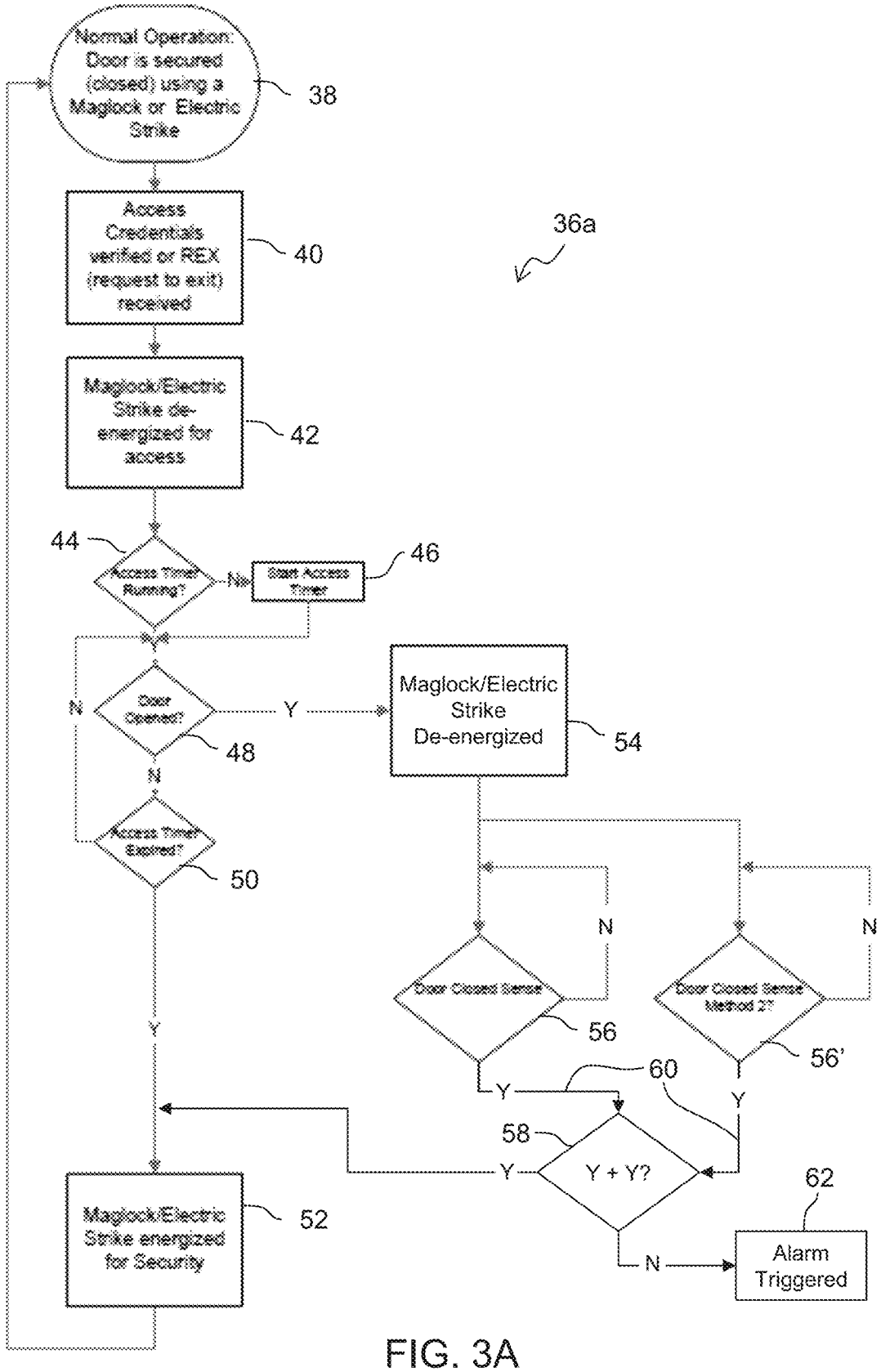
FIG. 3A is a flow chart similar to FIG. 3 illustrating an alternate operating method for the electromagnetic door locking system in accordance with the invention.

Turning now to FIG. 3*a*, a flow chart of method 36*a* is shown wherein a back-up door position sensor such as 32*a* may be used to detect a malfunctioning door position sensor and to trigger an alarm in the event that either door position sensor 32 or back-up door position sensor 32*a* malfunctions. Steps 38, 40, 42, 44, 46, 48, 50, 52, 54, 56 and 56' of method 36*a* are identical to the identically numbered steps in method 36. At step 58, microprocessor 29 determines whether both door position sensor 32 and back-up door position sensor 32*a* have provided a door closed communication signal 60. If both communication signals are received, or if only one communication signal is received from either door position sensor 32 or back-up door position sensor 32*a*, power control circuit 28 re-energizes electromagnet 20 thereby regenerating the electromagnetic attraction between electromagnet 20 and armature 22 and re-securing door 12 within frame 16. Further, if only one communication signal is received from either door position sensor 32 or back-up door position sensor 32*a*, at step 62, microprocessor 29 causes an alarm to be triggered, providing an alert that a door position sensor has malfunctioned. The alarm may be in the form of an audible signal, a visual signal such as colored LEDs or the like, or a visual notice sent to a video screen.

By way of example, current systems re-energize the electromagnet upon expiration of the predetermined period of time. That is, the door remains unlocked until the user-selected time period expires. As a result, unauthorized entry may be made by "piggybacking" on another individual's input of verified access credentials thereby circumventing the purpose of the authentication device and presenting a potential safety hazard. The present invention alleviates this possibility by re-energizing the electromagnet upon the power control circuit's receipt of the door closed communication signal. Thus, if the door should be opened and closed before expiration of the predetermined time period, the electromagnet is re-energized upon closing of the door without requiring the expiration of that time period (and thereby preventing a piggy-backed re-entry).

A further example offers energy savings by the instant invention. As discussed above, current systems simply re-energize the electromagnet at the expiration of the predetermined period of time regardless of the position of the door. Thus, should the door be propped open after expiration of the time period, the electromagnet will be re-energized without attracting the aperture or securing the door. In other words, energy is wasted unnecessarily powering the electromagnet. In contrast, one aspect of the present invention enables the power control circuit to override the timer once the power control circuit receives a door open communication signal from the door position sensor. The electromagnet will then only become re-energized upon receipt of a door closed communication signal irrespective of any timer. Thus, the door may be propped open for an indeterminate period of time without the power control circuit unnecessarily re-energizing the electromagnet. Moreover, should an entry event take longer to complete that the pre-selected time delay (e.g., 30 seconds), the electromagnet will remain de-energized and only become energized when the door returns to its closed state.

The invention described so far, provides for an energy savings for much of the time when a door secured by an electromagnetic door locking system is opened and its armature 22 is separated from its electromagnet 20. A further energy saving may be realized during the time the door is closed and no attempt is being made to open the door for an intended entry. This is done by switching the power provided to the electromagnet from a high holding force mode to a lower "eco-power" force mode while the door is closed and no attempt is made to open the door. In this embodiment, when in the eco-power force mode, just enough power is provided to the electromagnet by the power control circuit to hold the door closed against naturally occurring external forces such as vibration or wind. When an unauthorized attempt to open the door is made, the power control circuit provides full power to the electromagnet, switching the electromagnet to its high holding force mode, thereby holding the door secured against the frame.

Detection of an unauthorized attempt to open a door secured by an electromagnetic door release mechanism may be accomplished in several ways. In the power savings security system disclosed in U.S. Publication No. 2011/0018680, and incorporated herein by reference, a door-mounted accelerometer 132 (FIG. 1) that senses door vibrations is disclosed as a way of detecting an unauthorized attempt. When the door is touched without an authorization being sent by the authentication module, the accelerometer outputs a triggering signal to the power control circuit to switch the electromagnet to its high holding force mode. The power savings device disclosed in U.S. Publication No. 2010/0325967, and incorporated herein by reference, describes several additional types of sensors capable of sensing when an unauthorized attempt is being made to open a secured door. Sensors external to the electromagnetic device are disclosed such as, for example, a piezoelectric element 232 (FIG. 1) capable of sensing a force change exerted on the door or a proximity sensor 332 (FIG. 1) for sensing the presence of objects near the magnetic door lock or the door itself. Further, in U.S. Publication No. 2010/0325967, a sensor 432 (FIG. 1) for detecting an unauthorized attempt to open the door that is internal to the electromagnetic device is disclosed. As described, the sensor detects changes in the magnetic bond that are created when the armature begins to separate from the electromagnet. As the armature begins to separate, a change in current that is passing through the magnetic coil is sensed which is indicative of changes in the magnetic field and therefore indicative of an unauthorized attempt to open the door.

In accordance with the invention, regardless of the type of sensor used to provide a signal to the power control circuit when an unauthorized attempt to open the door is being made, the power control circuit used to switch the power delivered to the electromagnet between a high holding force mode and an eco-power force mode utilizes a pulse-width modulator controller to vary the current supplied to the electromagnet. When an unauthorized attempt to open the door is made, the door position sensor signals the pulse width modulator controller to adjust the cycle of the current signal supplied to the electromagnet thereby switching the electromagnet to its high holding force mode.

Figure 4:
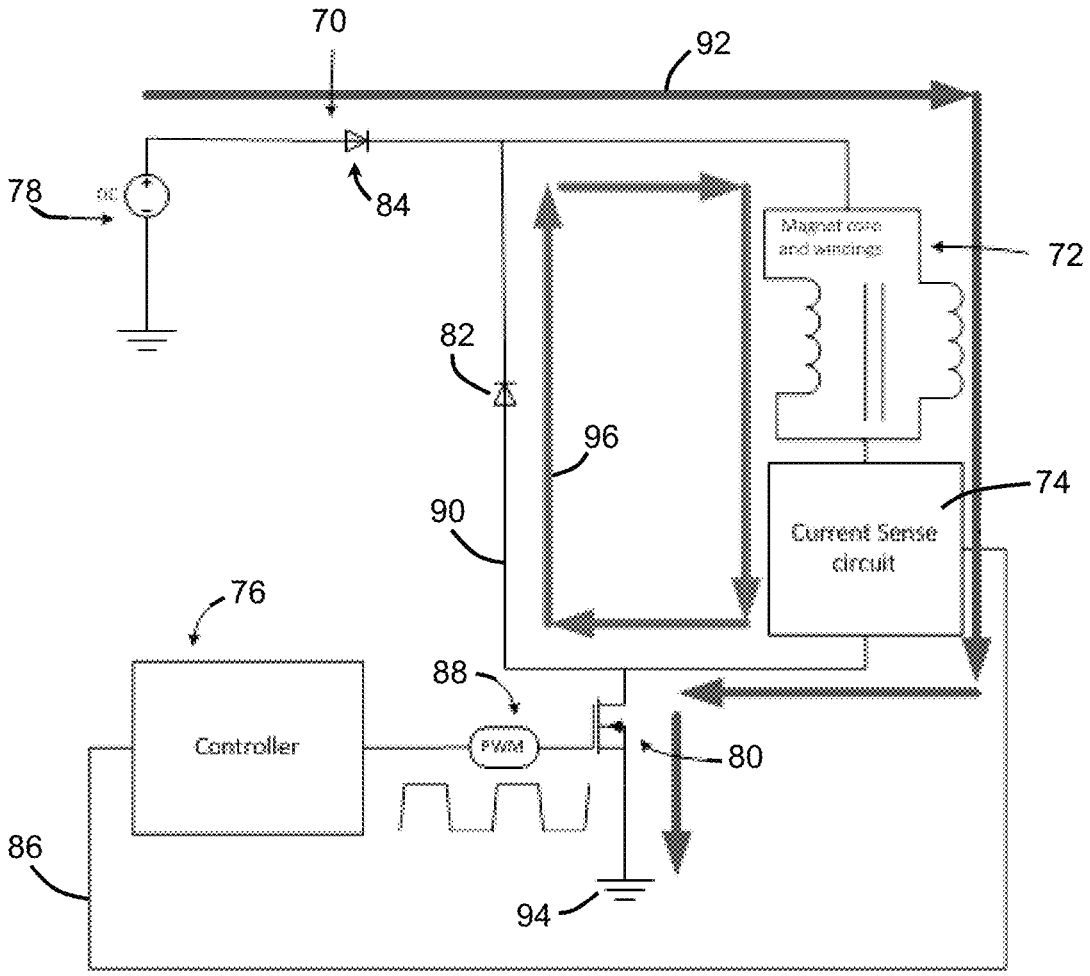
FIG. 4 is a schematic view of an exemplary circuit for implementing an operating method for the electromagnetic door locking system in accordance with the present invention.

Turning now to FIG. 4, a schematic view is shown of an exemplary energy-saving power control circuit 70 for operating an electromagnetic door locking system. The electromagnetic door locking system may include an electromagnetic door lock 30 as described above, a solenoid actuated door lock or any other locking device using an electromagnet as an actuator. Power control circuit 70 includes the magnetic core windings 72 of the electromagnetic door locking system, current sense circuit 74, controller 76, DC power supply 78 and switches 80, 82 and 84. Switch 80 may be a transistor such as, for example, a MOSFET transistor and switches 82 and 84 may be diodes. Without limiting strictly thereto, power control circuit 70 may be utilized as power control circuit 28 (FIG. 2) of an electromagnetic door lock system 10 having an eco-power force mode and a high-holding force mode as described above.

In operation, the current-sense circuit 74 reads the current flowing through the magnetic core windings 72. Controller 76 then receives a feedback voltage signal 86 from current-sense circuit 74 and generates a pulse-width modulated signal 88 to switch 80. Signal 88 has an effective duty cycle that results in a fixed current 90 flowing through the magnetic core s 72 as needed to maintain a predetermined and desired magnetic holding force by the locking system. By increasing or decreasing the duty cycle of pulse-width modulated signal 88, current to the windings (and the holding force of the electromagnetic locking system) can be selectively increased or decreased.

During the time the pulse-width modulated signal is in the positive (on) portion of its duty cycle, current 92 flows from DC power supply 78 through switch 84 and to the magnetic core windings 72. Current-sense circuit 74 monitors the current through the windings and provides feedback voltage signal 86 to controller 76. Current 90 flowing through the windings continues through switch 80 and to ground 94. When the pulse-width modulated signal is in the negative (off) portion of its duty cycle, current is prevented from flowing to ground 94. Instead, the winding current continues to flow through switch 82.

Furthermore, in one aspect of the invention, during the negative portion of the duty cycle, a level of inductive current 96 continues to flow through the magnetic core windings 72. The stored energy in the inductance associated with the windings (when the voltage across the windings change due to the "on/off" pulse-width-modulated voltage across the windings) maintains a constant current flow through the magnetic core windings 72. This inductive current 96 flows through switch 82, and returns to the windings to maintain a constant current. During the positive portion of the duty cycle, the energy that was lost from the windings during the negative portion of the duty cycle is replenished, enabling the above-described constant current flow through the windings to be maintained.

Figure 5:
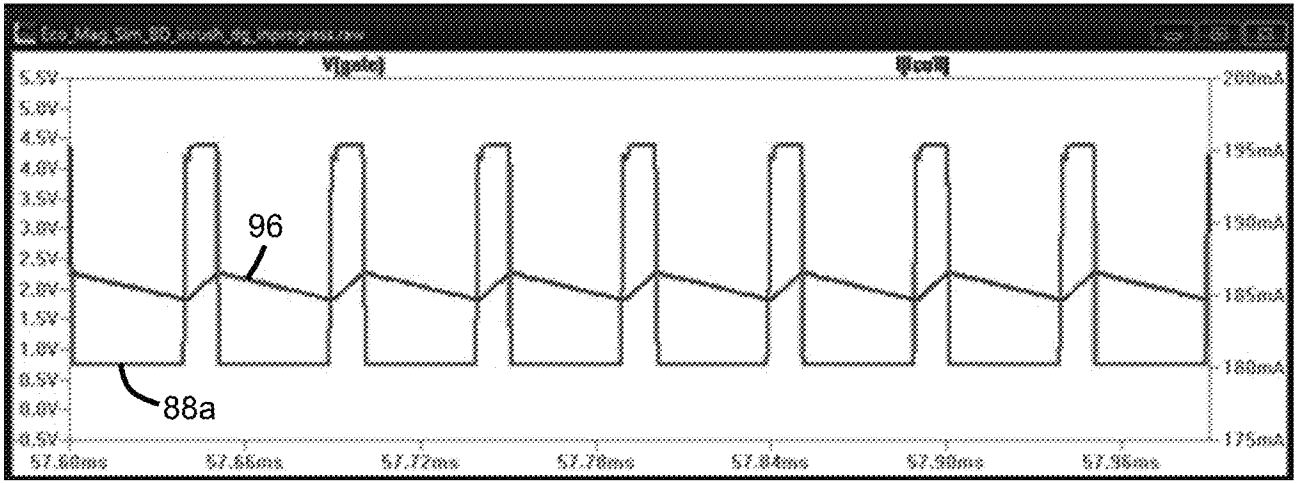
FIG. 5 is a graph showing a pulse width modulated signal with a 25% duty cycle and showing a constant inductive current developed in accordance with the invention.

FIG. 5 illustrates a pulse-width modulated signal (Vgate) 88*a* as would be applied to switch 80 in accordance with the invention. A 25% duty cycle is shown meaning that it is a positive signal only 25% of the total amount of time represented by one cycle. Inductive current 96 provides the current feedback during the remaining 75% of the cycle time while current continues to flow through the magnetic core 72. During the positive portion of the pulse-width modulated cycle, inductive current 92 increases above the average value, and during the negative portion, inductive current 96 decreases below the average value. In the example shown in FIG. 5, an average coil current 96 of about 185 mA would be sustained.

Figure 6:
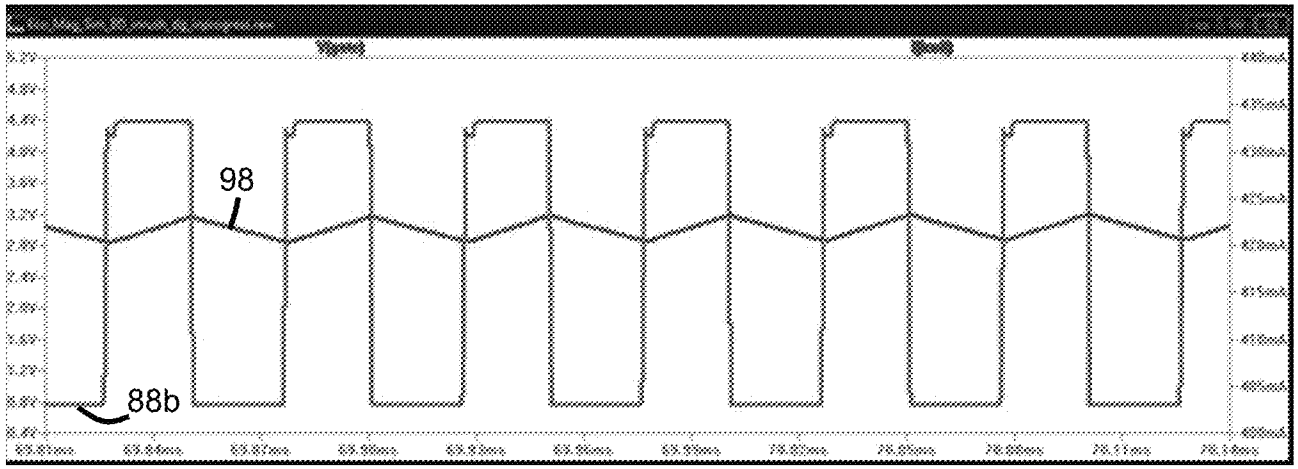
FIG. 6 is a graph showing a pulse width modulated signal with a 50% duty cycle and showing a constant inductive current developed in accordance with the invention.

FIG. 6 illustrates a pulse width modulated signal (Vgate) 88*b* having a 50% duty cycle as would be applied to switch 80 in accordance with the invention. In the example shown in FIG. 6, an average coil current 98 of about 422 mA would be sustained.

In the examples shown, the constant inductive current that would otherwise be lost is instead captured and used to supplement the power developed by power source 78 and needed to operate the electromagnetic system at the desired holding force.

Power control circuit 70 generally consists of a feedback circuit which may selectively energize one or more electromagnetic coils with either a default low current configured to maintain door 12 in a locked state with minimal holding force (eco-power force mode) while using a small amount of power and a high current (high holding force mode) configured to energize the electromagnetic coils so as to generate a high (full) holding force thereby preventing unauthorized opening of the door.

In accordance with an aspect of the present invention, the system may operate at multiple energy settings (e.g., maximum security, medium security, minimum security, low-power mode, etc.) depending upon the security needs where the door lock system is employed.

In accordance with an aspect of the invention, when the door is closed and in its default state (i.e. is locked without any force being imposed from an unauthorized attempt to open the door), the electromagnet may be energized with a reduced current wherein this reduced current is selected to generate an electromagnetic holding force between the electromagnet and the armature sufficiently strong enough to maintain the door in the closed position when naturally occurring external forces are applied to the door (i.e., the eco-holding force mode). However, should an unauthorized attempt to open the door be made, the door position sensor may instigate nearly instantaneous ramping of the electromagnetic coil current by the power control circuit so as to generate a high electromagnetic holding force (i.e., the high holding force mode) such that the door is secured in the closed position.

Thus, since the current through the electromagnet coils is maintained by varying the pulse width of the voltage across the coils and not by adding resistance to the circuit, heat that would otherwise be dissipated by the added resistance no longer has to be accounted for. A further advantage is that the system can operate at any voltage level. If, for example, the system operates at 24V input, a reduced duty ratio would yield the same current through the electromagnet coils as a 12V input at a higher duty ratio.

It should be noted that the energy saving system described in FIGS. 3 and 3A, when coupled with the energy saving system described in FIG. 4 would provide an energy savings package that would yield energy savings throughout all operating modes of an electromagnetic door locking system, that is, while the door is closed and after the door is opened by an authorized entry. However, energy savings may result from either of the systems disclosed, if used separately.

It should be noted that the PWM, constant current feedback circuitry as described in FIG. 4 may find similar energy saving advantages when used to power electromagnetic lock systems that do not utilize the multi-power level feature of the eco-power circuit described above.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An electromagnetic door locking system configured to cooperate with a door movable in a door frame, said door movable from a closed position to a non-closed position, the system comprising:

a) an energizable electromagnet configured to be affixed to one of said door or said door frame for electromagnetically attracting an armature, said armature affixed to the other of said door or said door frame, wherein when said door is in said closed position and said electromagnet is energized, said armature is attracted to said electromagnet thereby placing said door in a locked mode;

b) a power control circuit configured to selectively energize said electromagnet;

c) a first sensor configured to sense a first door position when said door is in said closed position and a second door position when said door is not in said closed position, wherein said door is in said closed position when said armature is engaged with said electromagnet, and wherein said door is not in said closed position when said armature is not engaged with said electromagnet; and d) an authentication module connected to said power control circuit, said authentication module configured to receive access credentials and send an authentication signal to said power control circuit, wherein said electromagnet is energized by said power control circuit when said first sensor senses said first door position, wherein said electromagnet is de-energized for a first predetermined period of time upon receipt of said authentication signal, and wherein if said first sensor does not sense said first door position after sensing said second door position, said electromagnet remains de-energized irrespective of said predetermined period of time.

2. The electromagnetic door locking system of claim 1 further comprising a second sensor separate from said first sensor, wherein said second sensor senses said second door position.

3. The electromagnetic door locking system of claim 1 wherein said first sensor is selected from one or more of the following: an accelerometer, a capacitive sensor, a voltage sensor, a current sensor, an image sensor, a photo sensor, a pressure sensor, a micro switch, a passive infrared sensor, a radio frequency (RF) sensor and a reed switch.

4. The electromagnetic door locking system of claim 1 wherein said first sensor is configured to sense a change in magnetic bond between said electromagnet and said armature.

5. The electromagnetic door locking system of claim 1 wherein said first predetermined period of time is selectable.

6. The electromagnetic door locking system of claim 1 wherein said authentication module is one or more of a keypad, swipe card reader, key fob reader or biometric sensor.

7. An electromagnetic door locking system configured to cooperate with a door movable in a door frame, said door movable from a closed position to a non-closed position, the system comprising:

a) an energizable electromagnet configured to be affixed to one of said door or said door frame for electromagnetically attracting an armature, said armature affixed to the other of said door or said door frame, wherein when said door is in said closed position and said electromagnet is energized, said armature is attracted to said electromagnet thereby placing said door in a locked mode;

b) a power control circuit configured to selectively energize said electromagnet;

c) a first sensor configured to sense a first door position when said door is in said closed position and to sense a second door position when said door is not in said closed position, wherein said door is in said closed position when said armature is engaged with said electromagnet, and wherein said door is not in said closed position when said armature is not engaged with said electromagnet; and d) an authentication module connected to said power control circuit, said authentication module configured to receive access credentials and send an authentication signal to said power control circuit, wherein said electromagnet is energized by said power control circuit when said first sensor senses said first door position, wherein said electromagnet is de-energized for a predetermined period of time upon receipt of said authentication signal by said power control circuit, and wherein upon sensing of said first door position by said first sensor after sensing said second door position, said electromagnet is energized irrespective of said predetermined period of time.

8. The electromagnetic door locking system in accordance with claim 7 further comprising a second sensor separate from said first sensor, wherein said second sensor senses said second door position.

9. The electromagnetic door locking system in accordance with claim 8 wherein said power control circuit is configured to trigger an alarm, and wherein said alarm is triggered by said power control circuit when one of said first sensor or said second sensor senses said first door position and the other of said first sensor or said second sensor does not sense said first door position.

10. The electromagnetic door locking system in accordance with claim 9 wherein said alarm comprises an audible signal, a visual signal or a visual notice.

11. The electromagnetic door locking system in accordance with claim 7 wherein said first sensor is selected from an accelerometer, a capacitive sensor, a voltage sensor, a current sensor, an image sensor, a photo sensor, a pressure sensor, a micro switch, a passive infrared sensor, a radio frequency sensor, a reed switch, or a magnetic bond sensor.

12. The electromagnetic door locking system in accordance with claim 7 wherein said first sensor is configured to sense a change in magnetic bond between said electromagnet and said first sensor.

13. The electromagnetic door locking system in accordance with claim 7 wherein said predetermined period of time is selectable.

14. The electromagnetic door locking system in accordance with claim 7 wherein said authentication module is a keypad, a swipe card reader, a key fob reader or a biometric sensor.

15. In an electromagnetic door locking system configured to cooperate with a door movable in a door frame, said door movable from a closed position to a non-closed position, the system wherein an energizable electromagnet is configured to be affixed to one of said door or said door frame for electromagnetically attracting an armature, wherein said armature affixed to the other of said door or said door frame, and wherein when said door is in said closed position and said electromagnet is energized, said armature is attracted to said electromagnet thereby placing said door in a locked mode, a method of controlling said energizing of said electromagnet, said method comprising the steps of:

a) providing a power control circuit configured to selectively energize said electromagnet, and to selectively de-energize said electromagnet for a predetermined period of time;

b) providing a sensor configured to sense when said door is in said closed position and when said door is in said non-closed position, and wherein said sensor is configured to send a first signal to said power control circuit when said door is in said closed position and to send a second signal to said power control circuit when said door is in said non-closed position, wherein said door is in said closed position when said armature is engaged with said electromagnet, and wherein said door is not in said closed position when said armature is not engaged with said electromagnet;

c) providing an authentication module configured to receive access credentials and to send an authentication signal to said power control circuit;

d) energizing said electromagnet when said first signal is sent to said power control module;

e) de-energizing said electromagnet for said predetermined period of time when said authentication signal is sent to said power control circuit;

f) moving said door to said non-closed position;

g) receiving said second signal by said power control circuit;

h) not receiving said first signal by said power control circuit after receiving said second signal; and i) maintaining said electromagnet in said de-energized state irrespective of whether said predermined period of time has elapsed.

16. In an electromagnetic door locking system configured to cooperate with a door movable in a door frame, said door movable from a closed position to a non-closed position, the system wherein an energizable electromagnet is configured to be affixed to one of said door or said door frame for electromagnetically attracting an armature, wherein said armature affixed to the other of said door or said door frame, and wherein when said door is in said closed position and said electromagnet is energized, said armature is attracted to said electromagnet thereby placing said door in a locked mode, a method of controlling said energizing of said electromagnet, said method comprising the steps of:

a) providing a power control circuit configured to selectively energize said electromagnet, and to selectively de-energize said electromagnet for a predetermined period of time;

b) providing a sensor configured to sense when said door is in said closed position and when said door is in said non-closed position, and wherein said sensor is configured to send a first signal to said power control circuit when said door is in said closed position and to send a second signal to said power control circuit when said door is in said non-closed position, wherein said door is in said closed position when said armature is engaged with said electromagnet, and wherein said door is not in said closed position when said armature is not engaged with said electromagnet;

c) providing an authentication module configured to receive access credentials and to send an authentication signal to said power control circuit;

d) energizing said electromagnet when said first signal is sent to said power control module;

e) de-energizing said electromagnet for said predetermined period of time when said authentication signal is sent to said power control circuit;

f) moving said door to said non-closed position;

g) receiving said second signal by said power control circuit;

h) receiving said first signal by said power control circuit after receiving said second signal; and i) re-energizing said electromagnet after step h) irrespective of whether said predetermined period of time has elapsed.

* * * * *